US011491544B2

(12) United States Patent
Liu

(10) Patent No.: US 11,491,544 B2
(45) Date of Patent: Nov. 8, 2022

(54) PREPARATION METHOD OF METAL POWDER MATERIAL

(71) Applicant: Li Liu, Ningbo (CN)

(72) Inventor: Li Liu, Ningbo (CN)

(73) Assignee: Li Liu, Ningbo (CN)

( * ) Notice: Subject to any disclaimer, the term of this patent is extended or adjusted under 35 U.S.C. 154(b) by 0 days.

(21) Appl. No.: 16/771,148

(22) PCT Filed: Jan. 19, 2020

(86) PCT No.: PCT/CN2020/072983
§ 371 (c)(1),
(2) Date: Jun. 9, 2020

(87) PCT Pub. No.: WO2020/168883
PCT Pub. Date: Aug. 27, 2020

(65) Prior Publication Data

US 2021/0370397 A1 Dec. 2, 2021

(30) Foreign Application Priority Data

Feb. 21, 2019 (CN) ..... 201910130592.1

(51) Int. Cl.
*B22F 9/16* (2006.01)
*B22F 1/05* (2022.01)
*B22F 1/065* (2022.01)

(52) U.S. Cl.
CPC ..... *B22F 9/16* (2013.01); *B22F 1/05* (2022.01); *B22F 1/065* (2022.01); *B22F 2009/165* (2013.01); *B22F 2301/205* (2013.01)

(58) Field of Classification Search
None
See application file for complete search history.

(56) References Cited

U.S. PATENT DOCUMENTS 6,632,113 B1 * 10/2003 Noma ..... B09B 5/00 445/2
9,067,264 B2 6/2015 Moxson
2011/0114175 A1 * 5/2011 Ozawa ..... H01L 31/02322 252/301.4 R
2012/0272788 A1 * 11/2012 Withers ..... B22F 9/082 75/335
2016/0273072 A1 * 9/2016 Khasin ..... C22B 47/00
2018/0297122 A1 * 10/2018 Hadidi ..... B22F 1/142
2019/0217395 A1 * 7/2019 Subramanian ..... B22F 1/065

FOREIGN PATENT DOCUMENTS

CN 101891216 A 11/2010
CN 104985194 A 10/2015
CN 107129305 A 9/2017
CN 107406251 A 11/2017
JP 2007314867 A 12/2007

OTHER PUBLICATIONS

International Search Report of PCT/CN2020/072983, dated Apr. 23, 2020.
Written Opinion of RCT/CN2020/072983, dated Apr. 19, 2020.

* cited by examiner

*Primary Examiner* — George Wyszomierski
(74) *Attorney, Agent, or Firm* — Dragon Sun Law Firm, PC; Jinggao Li; Nathaniel Perkins

(57) ABSTRACT

The present disclosure provides a preparation method of a metal powder material. An alloy sheet composed of a matrix phase and a dispersive phase with different chemical reactivities is prepared by the rapid solidification technique of alloy melt. Metal powder is prepared by the reaction of the alloy sheet and an acid solution. Please refer to the description for the detailed preparation method. This method is simple in operation, can be used to prepare many kinds of metal powder materials of different shapes and at the nanometer scale, the submicron scale and the micron scale, and has a good application prospect in the fields of catalysis, powder metallurgy and 3D printing.

20 Claims, 1 Drawing Sheet

PREPARATION METHOD OF METAL POWDER MATERIAL

CROSS-REFERENCE TO RELATED APPLICATIONS

This application is a national stage application of PCT Application No. PCT/CN2020/072983. This application claims priority from PCT Application No. PCT/CN2020/072983, filed Jan. 19, 2020, CN Application No. CN 201910130592.1 filed Feb. 21, 2019, the contents of which are incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the present disclosure described herein. All references cited and discussed in this specification are incorporated herein by reference in their entireties and to the same extent as if each reference was individually incorporated by reference.

FIELD

The present disclosure relates to the technical field of metal materials, in particular to a preparation method of a metal powder material with the micro-nano particle size.

BACKGROUND

Metal powder with the micro-nano particle size has a special surface effect, a quantum size effect, a quantum tunneling effect and a coulomb blocking effect and shows many unique performances different from the traditional material in the aspects of optical, electrical, magnetic and catalytic properties and thus is widely used in multiple fields such as optical electronic components, absorbing materials and high-performance catalysts.

At present, the preparation methods of ultrafine metal powder can be divided into the solid phase method, the liquid phase method and the gas phase method according to the state of matter. The solid phase method mainly includes the mechanical pulverizing method, the ultrasonic crushing method, the thermal decomposition method, and the explosion method. The liquid phase method mainly includes the precipitation method, the alkoxide method, the carbonyl method, the spray thermal drying method, the freeze-drying method, the electrolysis method, and the chemical condensation method. The gas phase method mainly includes the gas phase reaction method, the plasma method, the high temperature plasma method, the evaporation method, and the chemical vapor deposition method. Although there are many methods for preparing ultrafine metal powder, each method has some limitations. For example, the disadvantages of the liquid phase method are low yield, high cost and complex process. The disadvantage of the mechanical method is that powder grading is difficult after the powder is prepared, and it is hard to guarantee the purity, fineness and morphology of the powder. The rotary electrode method and the gas atomization method are the current main methods for the preparation of high-performance metal and alloy powder, but the production efficiency is low, the yield of ultrafine powder is not high, and the energy consumption is relatively large. The air flow grinding method and the hydrogenation dehydrogenation method are suitable for mass industrial production, but they have strong selectivity for raw metal and alloy. Therefore, it is of great significance to develop a new preparation method for ultrafine metal powder materials.

Therefore, a heretofore unaddressed need exists in the art to address the aforementioned deficiencies and inadequacies.

SUMMARY

On this basis, it is necessary to provide, in response to the above technical problems, a simple and easy method for the preparation of metal powder with the micro-nano particle size.

The present disclosure provides a preparation method of a metal powder material, which includes the following steps:

providing an alloy sheet, wherein the composition of the alloy sheet is $M_aN_b$, M is selected from at least one of Mg, Ca, Li, Na, K, Ba, Al, Co, Cu, Y, La, Ce, Pr, Nd, Pm, Sm, Eu, Gd, Tb, Dy, Ho, Er, Tm, Yb, and Lu, N is selected from at least one of W, Cr, Mo, V, Ta, Nb, Zr, Hf, and Ti, and a and b represent the atomic percentage content of the corresponding element, and $0.1\% \leq b \leq 45\%$, $a+b=100\%$; the microstructure of the alloy sheet is composed of a matrix phase with component M and a dispersive particle phase with component N;

making the alloy sheet react with an acid solution, so that the matrix phase with component M reacts with H+ of the acid solution to become metal ions to enter the solution, and the dispersive particle phase with component N is separated, and the metal N powder material is obtained.

Further, the alloy sheet is obtained by the following steps:

weighting metal raw materials according to a ratio;

fully melting the metal raw materials to obtain a metal melt;

preparing the metal melt into the alloy sheet by a rapid solidification method, wherein the solidification rate of the metal melt is 0.1 K/s~$10^7$K/s.

Further, the thickness of the alloy sheet is 5 μm~20 mm.

Further, the particle shape of the dispersive particle phase of the metal N includes at least one of the dendrite shape, spherical shape, subsphaeroidal shape, square, pie, and bar shape, and the particle size is 2 nm~500 μm.

Further, the acid in the acid solution is at least one of sulfuric acid, hydrochloric acid, nitric acid, perchloric acid, phosphoric acid, acetic acid, oxalic acid, formic acid, carbonic acid, gluconic acid, oleic acid, and polyacrylic acid, and the solvent in the acid solution is water, ethanol, methanol or a mixture of the three in any proportion.

Further, the molar concentration of the acid in the acid solution is 0.001 mol/L~10 mol/L.

Further, in the step of making the alloy sheet react with the acid solution, the reaction time is from 0.1 min to 300 min, and the reaction temperature is from 0° C. to 100° C.

Further, after the step of making the alloy sheet react with the acid solution, the following steps are performed: the obtained metal N powder material is screened, and then is subjected to plasma spheroidization treatment, and finally the metal N powder material with different particle sizes and of the spherical shape is obtained.

Further, the particle size of the metal N powder material with different particle sizes and of the spherical shape is 2 nm~500 μm.

The preparation method of the metal powder material has the following advantages:

First, when preparing the alloy sheet, the metal M and metal N of the specific category are selected to make the alloy melt composed of the metal M and metal N form two separate phases during the cooling process, that is, the matrix phase composed of the metal M and the dispersive particle phase composed of the metal N. This kind of structure is conducive to the subsequent reaction with the acid solution, during which the matrix phase of the metal M becomes ions and enters the solution, and the dispersive particle phase of the metal N is separated from the alloy to finally obtain the metal N powder material.

Second, the metal M with higher chemical activity is selected, and the metal M can react with H+ in the acid solution to become ions to enter the solution. The metal N with lower chemical activity is selected, and by selecting the appropriate reaction conditions, the metal N almost does not react with H+ in the selected acid solution. Therefore, the metal M is removed from the alloy by the acid solution, and the metal N powder material is finally obtained.

This method is low in cost and simple in operation, and can be used to prepare many kinds of metal powder materials of different shapes and at the nanometer scale, the submicron scale and the micron scale. This metal powder material has a good application prospect in the fields of catalysis, powder metallurgy and 3D printing.

BRIEF DESCRIPTION OF THE DRAWINGS

The accompanying drawings illustrate one or more embodiments of the present invention and, together with the written description, serve to explain the principles of the invention. Wherever possible, the same reference numbers are used throughout the drawings to refer to the same or like elements of an embodiment.

DETAILED DESCRIPTION OF THE EMBODIMENTS

Figure 1:
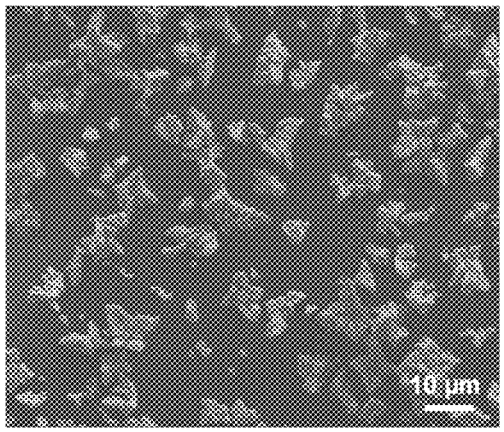
FIG. 1 is a stereoscan photograph of Hf powder in Embodiment 3 of the present disclosure.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure is thorough and complete, and will fully convey the scope of the invention to those skilled in the art. Like reference numerals refer to like elements throughout.

The present disclosure is further described in detail below in combination with the drawings and the embodiments. It should be noted that the embodiments described below are intended to facilitate the understanding of the present disclosure and do not limit the disclosure in any way.

The present disclosure provides a preparation method of a metal powder material, which includes the following steps:

S1, an alloy sheet is provided, wherein the composition of the alloy sheet is $M_aN_b$, M is selected from at least one of Mg, Ca, Li, Na, K, Ba, Al, Co, Cu, Y, La, Ce, Pr, Nd, Pm, Sm, Eu, Gd, Tb, Dy, Ho, Er, Tm, Yb, and Lu, N is selected from at least one of W, Cr, Mo, V, Ta, Nb, Zr, Hf, and Ti, and a and b represent the atomic percentage content of the corresponding element, and 0.1%≤b≤45%, a+b=100%; the microstructure of the alloy sheet is composed of a matrix phase with component M and a dispersive particle phase with component N;

S2, the alloy sheet is reacted with an acid solution, so that the matrix phase with component M reacts with H+ of the acid solution to become metal ions to enter the solution, and the dispersive particle phase with component N is separated, and the metal N powder material is obtained.

In step S1, the alloy composition has a specific proportion. The principle is to ensure that the microstructure of the alloy sheet is composed of the matrix phase with component M and the dispersive particle phase with component N. Preferably, 0.1%≤b≤35%.

The alloy sheet is obtained by the following steps:

metal raw materials are weighed according to a ratio;

a metal melt is obtained by fully melting the metal raw materials;

the metal melt is prepared into the alloy sheet by a rapid solidification method.

Wherein, the rapid solidification method is not limited, can be the casting method, the melt spinning method, and the melt extraction method. The particle size and the shape of the resulting metal powder material are basically consistent with those of the dispersive particle phase of the metal N in the alloy. The particle size of the dispersive particle phase of the metal N is related to the solidification rate of the metal melt in the preparation process. Generally speaking, the particle size of the dispersive particle phase is negatively correlated with the cooling rate of the metal melt, that is, the larger the solidification rate of the metal melt is, the smaller the particle size of the dispersive particle phase is. The solidification rate of the metal melt can be 0.1K/s~$10^7$K/s; the particle size of the dispersive particle phase of the metal N may be 2 nm~500 μm. Preferably, the solidification rate of the metal melt is 0.1K/s~$10^6$K/s; the particle size of the dispersive particle phase of the metal N may be 2 nm~300 μm.

The particle shape of the dispersive particle phase of the metal N is not limited, and can include at least one of the dendrite shape, spherical shape, subsphaeroidal shape, square, pie, and bar shape. When the particle shape is the bar shape, the size of the particle refers to the diameter of the cross section of the bar.

The thickness of the alloy sheet is not limited, and is preferably 5 μm~5 mm in order to be more conducive to acid reaction. The width and the length of the alloy sheet are not limited, for example, the width may be 0.2 mm~2 m, and the length may be 1 mm~$10^3$ m.

In step S2, the acid solution is a solution containing H+. The H+ in the acid solution reacts with the metal M. The acid in the acid solution may be at least one of sulfuric acid, hydrochloric acid, nitric acid, perchloric acid, phosphoric acid, acetic acid, oxalic acid, formic acid, carbonic acid, gluconic acid, oleic acid, and polyacrylic acid, and the solvent in the acid solution is water, ethanol, methanol or a mixture of the three in any proportion. Preferably, the acid in the acid solution can be at least one of sulfuric acid, hydrochloric acid, nitric acid, perchloric acid, phosphoric acid, acetic acid and oxalic acid. The reason for the optimal selection of the solvent is that the presence of ethanol and methanol is conducive to the dispersion of the metal powder material which is not easy to aggregate. In addition, the rapid evaporation rate of ethanol and methanol is also conducive to the subsequent drying process and the recovery of salt.

The concentration of the acid in the acid solution is not limited, as long as the acid can react with the metal M and basically retain N. The reaction time is not limited, and the reaction temperature is not limited. The molar concentration of the acid in the acid solution may be 0.001 mol/L~10 mol/L. The reaction time can be 0.1 min~300 min, and the reaction temperature can be 0° C.~100° C.

Further, after step S2, the following steps can be performed: the obtained metal N powder material is screened, and then is subjected to plasma spheroidization treatment, and finally the metal N powder material with different particle sizes and of the spherical shape is obtained.

The screened powder material can be spheroidized by plasma spheroidization treatment.

The particle size of the metal N powder material with different particle sizes and of the spherical shape is 2 nm~500 μm.

The preparation method of the metal powder material has the following advantages:

First, when preparing the alloy sheet, the metal M and metal N of the specific category are selected to make the alloy melt composed of the metal M and metal N form two separate phases during the cooling process, that is, the matrix phase composed of the metal M and the dispersive particle phase composed of the metal N. This kind of structure is conducive to the subsequent reaction with the acid solution, during which the matrix phase of the metal M becomes ions and enters the solution, and the dispersive particle phase of the metal N is separated from the alloy to finally obtain the metal N powder material.

Second, the metal M with higher chemical activity is selected, and the metal M can react with H+ in the acid solution to become ions to enter the solution. The metal N with lower chemical activity is selected, and by selecting the appropriate reaction conditions, the metal N almost does not react with H+ in the selected acid solution. Therefore, the metal M is removed from the alloy by the acid solution, and the metal N powder material is finally obtained.

This method is low in cost and simple in operation, and can be used to prepare many kinds of metal powder materials of different shapes and at the nanometer scale, the submicron scale and the micron scale. This metal powder material has a good application prospect in the fields of catalysis, powder metallurgy and 3D printing.

Further illustration is conducted through each embodiment.

Embodiment 1

This embodiment provides a preparation method of submicron V powder, which includes the following steps:

(1) the alloy with the formula of $Ca_{98.5}V_{1.5}$ was selected, the raw materials were weighed according to the formula, and the $Ca_{98.5}V_{1.5}$ alloy was obtained after electric arc melting. The alloy was remelted by arc heating and then the $Ca_{98.5}V_{1.5}$ alloy sheet with the size of 1 mm×2 mm×10 mm was prepared by means of copper mold suction casting (the cooling rate was about 500K/s). The alloy structure consisted of a matrix phase composed of Ca and a submicron (100 nm~1 μm) dispersive particle phase composed of V.

(2) at room temperature, 0.2 g of the $Ca_{98.5}V_{1.5}$ alloy sheet prepared in step (1) was immersed into 50 mL of an aqueous sulfuric acid solution with the concentration of 0.1 mol/L. During the reaction process, the matrix composed of the active element Ca reacted with the acid and entered the solution, while the submicron subsphaeroidal V particles that did not react with the acid were gradually separated and dispersed from the matrix. After 5 min, the obtained subsphaeroidal V particles were separated from the solution. After being washed and dried, the submicron V powder was obtained, and the size of each V particle ranged from 100 nm~1 μm.

Embodiment 2

This embodiment provides a preparation method for submicron NbV alloy powder, which includes the following steps:

(1) the alloy with the formula of $Y_{98}(Nb_{50}V_{50})_2$ was selected, the raw materials were weighed according to the formula, and the $Y_{98}(Nb_{50}V_{50})_2$ alloy was obtained after electric arc melting. The alloy was remelted by arc heating and then the $Y_{98}(Nb_{50}V_{50})_2$ alloy sheet with the size of 1 mm×2 mm×10 mm was prepared by means of copper mold suction casting (the cooling rate was about 500K/s). The alloy structure consisted of a matrix composed of Y and a submicron (100 nm~1 μm) dispersive particle phase composed of NbV.

(2) at room temperature, 0.2 g of the $Y_{98}(Nb_{50}V_{50})_2$ alloy sheet prepared in step (1) was immersed into 50 mL of an aqueous sulfuric acid solution with the concentration of 0.1 mol/L. During the reaction process, the matrix composed of the active element Y reacted with the acid and entered the solution, while the submicron subsphaeroidal NbV alloy particles that did not react with the acid were gradually separated and dispersed from the matrix. After 10 min, the obtained subsphaeroidal NbV alloy particles were separated from the solution. After being washed and dried, the submicron NbV alloy powder was obtained, and the size of each NbV alloy particle ranged from 100 nm~1 μm.

Embodiment 3

This embodiment provides a preparation method for micron Hf powder, which includes the following steps:

(1) the alloy with the formula of $(Gd_{60}Co_{25}Al_{15})_{75}Hf_{25}$ was selected, the raw materials were weighed according to the formula, and the $(Gd_{60}Co_{25}Al_{15})_{75}Hf_{25}$ alloy was obtained after electric arc melting. The alloy was remelted by induction heating and poured into a copper mold with an internal chamber having the cross section size of 3 mm×6 mm, and was then casted with the cooling rate of about 100K/s to prepare an alloy sheet with the size of 3 mm×6 mm×30 mm, and the alloy structure included the matrix composed of the elements Gd, Co and Al and the dispersive dendrite particles composed of Hf, and the size of a single dendrite particle ranged from 1 μm~20 μm.

(2) at room temperature, 0.5 g of the $(Gd_{60}Co_{25}Al_{15})_{75}Hf_{25}$ alloy sheet prepared in step (1) was immersed into 100 mL of an aqueous hydrochloric acid solution with the concentration of 0.5 mol/L. During the reaction process, the matrix composed of the highly active elements Gd, Co and Al reacted with the hydrochloric acid and entered the solution, while the dendrite Hf particles that did not react with the hydrochloric acid were gradually separated and dispersed from the matrix. After 20 min, the obtained dendrite Hf particles were separated from the solution. After being washed and dried, the micron dendrite Hf powder was obtained, and the size of a single dendrite particle ranged from 1 μm~20 μm.

The obtained powder material was tested by stereoscan. As can be seen from FIG. 1, the powder particles were of the dendrite shape.

Embodiment 4

This embodiment provides the preparation of spherical micron Hf powder, which includes the following steps:

(1) the alloy with the formula of $(Gd_{60}Co_{25}Al_{15})_{75}Hf_{25}$ was selected, the raw materials were weighed according to the formula, and the $(Gd_{60}Co_{25}Al_{15})_{75}Hf_{25}$ alloy was obtained after electric arc melting. The alloy was remelted by induction heating and poured into a copper mold with an internal chamber having the cross section size of 3 mm×6 mm, and was then casted with the cooling rate of about 100K/s to prepare an alloy sheet with the size of 3 mm×6 mm×60 mm, and the alloy structure included the matrix composed of elements Gd, Co and Al and the dispersive dendrite particles composed of Hf, and the size of a single dendrite particle ranged from 1 μm~20 μm.

(2) at room temperature, 10 g of $(Gd_{60}Co_{25}Al_{15})_{75}Hf_{25}$ alloy sheet prepared in step (1) was immersed into 500 mL of an aqueous hydrochloric acid solution with the concentration of 1 mol/L. During the reaction process, the matrix composed of the highly active elements Gd, Co and Al reacted with the hydrochloric acid and entered into the solution, while the dendrite Hf particles that did not react with hydrochloric acid were gradually separated and dispersed from the matrix. After 20 min, the dendrite Hf particles were separated from the solution. After being washed and dried, the micron dendrite Hf powder was obtained, and the size of a single dendrite particle ranged from 1 μm~20 μm, as showed in FIG. 1.

(3) 0.5 kg of the micron dendrite Hf powder prepared by step (2) was collected and screened through sieves of 1000 mesh, 2000 mesh and 8000 mesh to obtain graded dendrite Hf powder with dendrite particle sizes of >13 μm, 13 μm~6.5 μm, 6.5 μm~1.6 μm and <1.6 μm, respectively. The dendrite Hf powder with dendrite particle sizes of 13 μm~6.5 μm and 6.5 μm~1.6 μm was selected, and the spherical Hf powder with particle sizes of 13 μm~6.5 μm and 6.5 μm~1.6 μm was prepared through mature plasma spheroidization technology.

Embodiment 5

This embodiment provides a preparation method of nanometer Zr powder, which includes the following steps:

(1) the alloy with the formula of $Gd_{80}Zr_{20}$ was selected, the raw materials were weighed according to the formula, and the $Gd_{80}Zr_{20}$ alloy was obtained after electric arc melting. The alloy was remelted by induction heating to prepare a $Gd_{80}Zr_{20}$ alloy strip with the thickness of about 300 μm and the width of 3 μm by using the method of copper roller melt-spinning. The alloy structure included the matrix composed of Gd and the dispersive particle phase composed of Zr. The shape of the dispersive particle phase can be the spherical shape, the subsphaeroidal shape, and the bar shape with a length-diameter ratio of 20:1~1.5:1. The diameter of a single particle ranged from 10 nm~120 nm.

(2) at room temperature, 0.5 g of the solution $Gd_{80}Zr_{20}$ alloy strip prepared in step (1) was immersed into 100 mL of an aqueous hydrochloric acid solution with the concentration of 0.5 mol/L. During the reaction process, the matrix composed of the active element Gd reacted with the hydrochloric acid and entered the solution, while the Zr particles of different shapes that did not react with hydrochloric acid were gradually separated and dispersed from the matrix. After 20 min, the Zr nanoparticles of different shapes were separated from the solution. After being washed and dried, the Zr nanoparticles of the spherical shape, the subsphaeroidal shape, and the bar shape with a length-diameter ratio of 20:1~1.5:1 were obtained. The diameter of a single particle ranged from 10 nm~120 nm.

Figure 2:
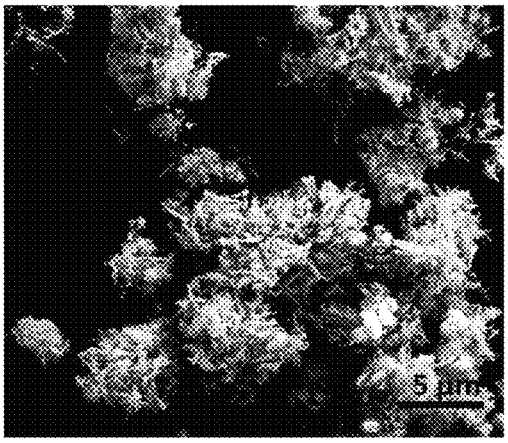
FIG. 2 is a stereoscan macrograph of Zr powder of Embodiment 5 of the present disclosure.
Figure 3:
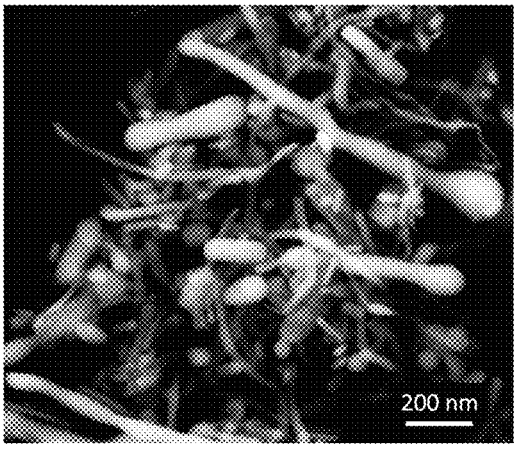
FIG. 3 is a stereoscan high-power photograph of Zr powder of Embodiment 5 of the present disclosure.

The obtained powder material was tested by stereoscan, and the results were shown in FIG. 2 and FIG. 3. As can be seen from FIG. 2 and FIG. 3, most of the Zr nanoparticles were bar shaped and a few were spherical.

Embodiment 6

This embodiment provides the preparation of spherical nanometer Zr powder, which includes the following steps:

(1) the alloy with the formula of $Gd_{80}Zr_{20}$ was selected, the raw materials were weighed according to the formula, and the $Gd_{80}Zr_{20}$ alloy was obtained after electric arc melting. The alloy was remelted by induction heating to prepare a $Gd_{80}Zr_{20}$ alloy strip with the thickness of about 300 μm and the width of 3 μm by using the method of copper roller melt-spinning. The alloy structure included the matrix composed of Gd and the dispersive particle phase composed of Zr. The shape of the dispersive particle phase can be the spherical shape, the subsphaeroidal shape, and the bar shape with a length-diameter ratio of 20:1~1.5:1. The diameter of a single particle ranged from 10 nm~120 nm.

(2) at room temperature, 0.5 g of the $Gd_{80}Zr_{20}$ alloy strip prepared in step (1) was immersed into 100 mL of an aqueous nitric acid solution with the concentration of 0.5 mol/L. During the reaction process, the matrix composed of the active element Gd reacted with the nitric acid and entered the solution, while the Zr particles of different shapes that did not react with nitric acid were gradually separated and dispersed from the matrix. After 20 min, the Zr nanoparticles of different shapes were separated from the solution. After being washed and dried, the Zr nanoparticles of the spherical shape, the subsphaeroidal shape, and the bar shape with a length-diameter ratio of 20:1~1.5:1 were obtained. The diameter of a single particle ranged from 10 nm~120 nm.

(3) 0.2 kg of the nano powder prepared by step (2) was collected, and spherical nano Zr powder with the particle size ranging from 10 nm~200 nm was further prepared by mature plasma spheroidization technology.

The technical features of the above embodiments may be arbitrarily combined. For the purpose of conciseness of depiction, all possible combinations of the technical features of the above embodiments have not been described. However, as long as there is no contradiction between the combinations of these technical features, they shall be considered to be within the scope of the description.

The above embodiments only express several embodiments of the disclosure, and their descriptions are more specific and detailed, but they cannot be understood as a limitation on the scope of the present disclosure. It should be noted that for the ordinary skilled in the field, a number of variations and improvements can be made on the premise of not deviating from the concept of the disclosure, which all fall within the scope of protection of the disclosure. Therefore, the scope of protection of the present disclosure shall be subject to the attached claims.

The foregoing description of the exemplary embodiments of the present invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A preparation method of a metal powder material, comprising the following steps:

providing an alloy sheet, wherein the composition of the alloy sheet is $M_aN_b$, M is selected from the group consisting of Y, La, Ce, Pr, Nd, Pm, Sm, Eu, Gd, Tb, Dy, Ho, Er, Tm, Yb, Lu, and mixtures thereof, N is selected from the group consisting of W, Cr, Mo, V, Ta, Nb, Zr, Hf, Ti, and mixtures thereof, and a and b represent the atomic percentage content of the corresponding element, and $0.1\% \leq b \leq 45\%$, $a+b=100\%$; the microstructure of the alloy sheet is composed of a matrix phase with component M and a dispersive particle phase with component N; and making the alloy sheet react with an acid solution, so that the matrix phase with component M reacts with H+ of the acid solution to become metal ions to enter the solution, and the dispersive particle phase with component N is separated, and the metal N powder material is obtained.

2. The preparation method of the metal powder material according to claim 1, wherein the alloy sheet is obtained by the following steps:

weighting metal raw materials;

fully melting the metal raw materials to obtain a metal melt; and preparing the metal melt into the alloy sheet by a rapid solidification method, wherein the solidification rate of the metal melt is 0.1 K/s~$10^7$K/s.

3. The preparation method of the metal powder material according to 2, wherein, after the step of making the alloy sheet react with the acid solution, the following steps are performed: the obtained metal N powder material is screened, and then is subjected to plasma spheroidization treatment, and finally the metal N powder material with different particle sizes and of the spherical shape is obtained, wherein the metal N powder material comprises a mix of powders with more than one particle size.

4. The preparation method of the metal powder material according to claim 3, wherein the particle size of the metal N powder material with different particle sizes and of the spherical shape is 2 nm~500 μm.

5. The preparation method of the metal powder material according to claim 1, wherein the thickness of the alloy sheet is 5 μm~20 mm.

6. The preparation method of the metal powder material according to 5, wherein, after the step of making the alloy sheet react with the acid solution, the following steps are performed: the obtained metal N powder material is screened, and then is subjected to plasma spheroidization treatment, and finally the metal N powder material with different particle sizes and of the spherical shape is obtained, wherein the metal N powder material comprises a mix of powders with more than one particle size.

7. The preparation method of the metal powder material according to claim 6, wherein the particle size of the metal N powder material with different particle sizes and of the spherical shape is 2 nm~500 μm.

8. The preparation method of the metal powder material according to claim 1, wherein the particle shape of the dispersive particle phase of the metal N includes at least one of the dendrite shape, spherical shape, subspherical shape, square, pie, and bar shape, and the particle size is 2 nm~500 μm.

9. The preparation method of the metal powder material according to 8, wherein, after the step of making the alloy sheet react with the acid solution, the following steps are performed: the obtained metal N powder material is screened, and then is subjected to plasma spheroidization treatment, and finally the metal N powder material with different particle sizes and of the spherical shape is obtained, wherein the metal N powder material comprises a mix of powders with more than one particle size.

10. The preparation method of the metal powder material according to claim 9, wherein the particle size of the metal N powder material with different particle sizes and of the spherical shape is 2 nm~500 μm.

11. The preparation method of the metal powder material according to claim 1, wherein the acid in the acid solution is the group consisting of sulfuric acid, hydrochloric acid, nitric acid, perchloric acid, phosphoric acid, acetic acid, oxalic acid, formic acid, carbonic acid, gluconic acid, oleic acid, polyacrylic acid, and mixtures thereof, and the solvent in the acid solution is water, ethanol, methanol or a mixture of the three in any proportion.

12. The preparation method of the metal powder material according to claim 11, wherein the molar concentration of the acid in the acid solution is 0.001 mol/L~10 mol/L.

13. The preparation method of the metal powder material according to 12, wherein, after the step of making the alloy sheet react with the acid solution, the following steps are performed: the obtained metal N powder material is screened, and then is subjected to plasma spheroidization treatment, and finally the metal N powder material with different particle sizes and of the spherical shape is obtained, wherein the metal N powder material comprises a mix of powders with more than one particle size.

14. The preparation method of the metal powder material according to claim 13, wherein the particle size of the metal N powder material with different particle sizes and of the spherical shape is 2 nm~500 μm.

15. The preparation method of the metal powder material according to 11, wherein, after the step of making the alloy sheet react with the acid solution, the following steps are performed: the obtained metal N powder material is screened, and then is subjected to plasma spheroidization treatment, and finally the metal N powder material with different particle sizes and of the spherical shape is obtained, wherein the metal N powder material comprises a mix of powders with more than one particle size.

16. The preparation method of the metal powder material according to claim 15, wherein the particle size of the metal N powder material with different particle sizes and of the spherical shape is 2 nm~500 μm.

17. The preparation method of the metal powder material according to claim 1, wherein the step of making the alloy sheet react with the acid solution, the reaction time is from 0.1 min to 300 min, and the reaction temperature is from 0° C. to 100° C.

18. The preparation method of the metal powder material according to 17, wherein, after the step of making the alloy sheet react with the acid solution, the following steps are performed: the obtained metal N powder material is screened, and then is subjected to plasma spheroidization treatment, and finally the metal N powder material with different particle sizes and of the spherical shape is obtained, wherein the metal N powder material comprises a mix of powders with more than one particle size.

19. The preparation method of the metal powder material according to claim 1, wherein, after the step of making the alloy sheet react with the acid solution, the following steps are performed: the obtained metal N powder material is screened, and then is subjected to plasma spheroidization treatment, and finally the metal N powder material with different particle sizes and of the spherical shape is obtained, wherein the metal N powder material comprises a mix of powders with more than one particle size.

20. The preparation method of the metal powder material according to claim 19, wherein the particle size of the metal N powder material with different particle sizes and of the spherical shape is 2 nm~500 μm.

* * * * *